US007815751B2

(12) United States Patent
Pemberton et al.

(10) Patent No.: US 7,815,751 B2
(45) Date of Patent: Oct. 19, 2010

(54) ZIRCONIUM-VANADIUM CONVERSION COATING COMPOSITIONS FOR FERROUS METALS AND A METHOD FOR PROVIDING CONVERSION COATINGS

(75) Inventors: Joseph D. Pemberton, New Berlin, WI (US); John P. Jandrists, Chicago, IL (US)

(73) Assignee: Coral Chemical Company, Waukegan, IL (US)

( * ) Notice: Subject to any disclaimer, the term of this patent is extended or adjusted under 35 U.S.C. 154(b) by 562 days.

(21) Appl. No.: 11/237,267

(22) Filed: Sep. 28, 2005

(65) Prior Publication Data

US 2007/0068602 A1 Mar. 29, 2007

(51) Int. Cl.

| | |
|---|---|
| ***C23C 22/42*** | (2006.01) |
| ***C23C 22/44*** | (2006.01) |
| *C23C 22/34* | (2006.01) |
| *C23C 22/50* | (2006.01) |

(52) U.S. Cl. ..... 148/247; 148/243; 148/253; 148/277; 106/14.11; 106/14.12; 106/14.21

(58) Field of Classification Search ..... 148/243, 148/247, 253, 277; 106/14.11, 14.12, 14.21
See application file for complete search history.

(56) References Cited

U.S. PATENT DOCUMENTS

| | | | | |
|---|---|---|---|---|
| 3,391,032 | A | | 7/1968 | Hansen et al. |
| 3,695,942 | A | | 10/1972 | Binns |
| 3,819,424 | A | | 6/1974 | Russell et al. |
| 3,850,732 | A | | 11/1974 | Binns |
| 3,966,502 | A | | 6/1976 | Binns |
| 4,264,378 | A | | 4/1981 | Oppen et al. |
| 4,338,140 | A | | 7/1982 | Reghi |
| 4,341,558 | A | | 7/1982 | Yashiro et al. |
| 4,376,000 | A | | 3/1983 | Lindert |
| 4,389,260 | A | | 6/1983 | Hauffe et al. |
| 4,433,015 | A | | 2/1984 | Lindert |
| 4,470,853 | A | | 9/1984 | Das et al. |
| 4,517,028 | A | | 5/1985 | Lindert |
| 4,673,444 | A | | 6/1987 | Saito et al. |
| 4,828,615 | A | | 5/1989 | Cape |
| 4,838,957 | A | | 6/1989 | Miyamoto et al. |
| 4,992,115 | A | * | 2/1991 | Ikeda ..... 148/247 |
| 5,026,440 | A | | 6/1991 | Finnenthal et al. |
| 5,064,500 | A | | 11/1991 | Awad |
| 5,116,912 | A | | 5/1992 | Lindert et al. |
| 5,192,374 | A | | 3/1993 | Kindler |

(Continued)

FOREIGN PATENT DOCUMENTS

| | | |
|---|---|---|
| EP | 0643127 | 3/1995 |

(Continued)

*Primary Examiner*—Roy King
*Assistant Examiner*—Lois Zheng
(74) *Attorney, Agent, or Firm*—Fitch, Even, Tabin & Flannery

(57) ABSTRACT

The invention provides a method and composition for coating a ferrous metal surface with a zirconium/vanadium conversion coating which is substantially free of an organic film forming composition and tannins. The method is a low temperature method which contemplates an aqueous conversion coating composition which is low in phosphates and which comprises zirconium, vanadium, fluoride, as well as phosphate ions in a ratio and a concentration effective for providing a conversion-coated ferrous metal surface.

17 Claims, 1 Drawing Sheet

U.S. PATENT DOCUMENTS

| | | | | |
|---|---|---|---|---|
| 5,194,183 | A | 3/1993 | Munch et al. | |
| 5,207,840 | A | 5/1993 | Riesop et al. | |
| 5,281,282 | A | 1/1994 | Dolan et al. | |
| 5,294,266 | A | 3/1994 | Hauffe et al. | |
| 5,342,456 | A | 8/1994 | Dolan | |
| 5,372,656 | A | 12/1994 | Riesop | |
| 5,421,913 | A | 6/1995 | Ikeda et al. | |
| 5,427,632 | A | 6/1995 | Dolan | |
| 5,449,414 | A | 9/1995 | Dolan | |
| 5,449,415 | A | 9/1995 | Dolan | |
| 5,449,418 | A | 9/1995 | Takagi et al. | |
| 5,531,820 | A | 7/1996 | Gorecki | |
| 5,531,931 | A | 7/1996 | Koefod | |
| 5,534,082 | A | 7/1996 | Dollman et al. | |
| 5,603,754 | A | 2/1997 | Aoki et al. | |
| 5,635,084 | A | 6/1997 | Mansfeld et al. | |
| 5,759,244 | A | 6/1998 | Tomlinson | |
| 5,885,373 | A | 3/1999 | Sienkowski | |
| 5,891,952 | A | 4/1999 | McCormick et al. | |
| 5,937,390 | A | 8/1999 | Hyodo | |
| 5,938,861 | A * | 8/1999 | Inoue et al. | 148/247 |
| 5,952,049 | A | 9/1999 | Tomlinson | |
| 5,954,893 | A | 9/1999 | Baldwin et al. | |
| 5,958,511 | A | 9/1999 | Dolan | |
| 6,027,579 | A * | 2/2000 | Das et al. | 148/256 |
| 6,050,280 | A | 4/2000 | Jeske | |
| 6,083,309 | A | 7/2000 | Tomlinson | |
| 6,190,780 | B1 | 2/2001 | Shoji et al. | |
| 6,193,815 | B1 | 2/2001 | Wada et al. | |
| 6,248,184 | B1 | 6/2001 | Dull et al. | |
| 6,342,107 | B1 | 1/2002 | Miyamoto et al. | |
| 6,368,426 | B1 | 4/2002 | Sienkowski et al. | |
| 6,758,916 | B1 | 7/2004 | McCormick | |
| 6,764,553 | B2 * | 7/2004 | Dolan | 148/243 |
| 2003/0000418 | A1 | 1/2003 | Boulos | |
| 2003/0213533 | A1 * | 11/2003 | Sako et al. | 148/243 |
| 2004/0020564 | A1 | 2/2004 | Schenzle et al. | |
| 2004/0214022 | A1 | 10/2004 | Cuyler et al. | |
| 2006/0185769 | A1 * | 8/2006 | Nakayama et al. | 148/247 |

FOREIGN PATENT DOCUMENTS

| | | |
|---|---|---|
| WO | WO 93/05198 | 3/1993 |
| WO | WO 93/05201 | 3/1993 |
| WO | WO 96/07772 | 3/1996 |
| WO | WO 96/19595 | 6/1996 |
| WO | WO 96/34995 | 11/1996 |
| WO | WO 97/17480 | 5/1997 |
| WO | WO 99/08806 | 2/1999 |
| WO | WO 00/20657 | 4/2000 |
| WO | WO 01/20058 | 3/2001 |

* cited by examiner

ZIRCONIUM-VANADIUM CONVERSION COATING COMPOSITIONS FOR FERROUS METALS AND A METHOD FOR PROVIDING CONVERSION COATINGS

FIELD

This invention relates generally to an inorganic, zirconium and vanadium conversion coating composition for application onto ferrous metal substrates, such as sheet steel, cold-rolled steel and other such substrates and a low temperature method for using the conversion coating composition. The invention more particularly relates to improving the corrosion resistant properties of ferrous metal substrates with a zirconium and vanadium, inorganic, organic polymer free conversion coating which improves the adhesion of paints, inks, lacquers, siccative coatings, and other over-coatings to the conversion coated surface of the ferrous metal substrate.

BACKGROUND

The chemical treatment of various carbon steel alloys to provide an iron or zinc phosphate conversion coating is very common in the metal finishing industry. These conversion coatings are typically applied by spray or immersion application of an acidic solution containing phosphoric acid as a source of phosphate ions and dissolved metal ions such as iron and zinc. It is generally believed that these phosphate conversion coating compositions react with the ferrous substrate to form a conversion coating of iron/phosphate complexes, zinc/iron/phosphate complexes, or similar metal phosphate complexes. These resulting conversion coatings provide a protective function against corrosion of the ferrous metal substrate and promote the adhesion of subsequent organic coatings such as paints and inks. The bath of the conversion coating composition to which the metal is exposed is typically controlled within a pH range from about 2.5 to 5.5 and at a temperature of about 110 to 160° F. Further, prior art conversion coating compositions typically contained phosphate ions in the range from about 8000 to 20,000 parts per million. With mounting pressure within the finishing to comply with continually tightening process water effluent standards and energy conservation to counter rapid cost increases, the development of new conversion coating technologies have been investigated to reduce phosphate levels and process temperatures at which a bath is operated to provide a suitable conversion coating.

Thus, considerable efforts have been devoted to developing effective conversion coatings for ferrous metals which include organic compounds and film forming compositions. These attempts to develop such conversion coatings include polymeric and other organic coatings, tannic acid and other acidic compositions, and non chromate metal ion solutions. U.S. Pat. No. 4,338,140 to Reghi describes a coating for corrosion resistance with solutions which include zirconium, fluoride and tannin compounds at a pH of 1.5 to 3.5. These compositions also may include phosphate ions. U.S. Pat. No. 4,470,853 to Das describes a coating composition which includes zirconium, fluoride, tannin, phosphate and zinc at a pH of 2.3 to 2.95.

U.S. Pat. No. 5,342,456 to Dolan describes a dry in place coating composition which includes an anion component which has at least four fluorine atoms and at least one of zirconium, hafnium, silicon and boron with optional oxygen atoms; a cation component selected from cobalt, magnesium, manganese, zinc, nickel, tin, zirconium, iron, aluminum and copper, a compound which will form an organic resinous film upon drying in place and a pH of 0.5 to 5.0.

U.S. Pat. No. 6,758,916 to McCormick similarly describes a chrome free dry in place conversion coating composition which McCormick says has a flurometallate anion having at least four fluorine atoms and at least one of titanium, zirconium, hafnium, silicon, aluminum and boron with oxygen atoms; divalent or tetravalent cations of cobalt, magnesium, manganese, zinc, nickel, tin, zirconium, iron, aluminum and copper; an inorganic oxyanion component which has phosphorus; and a water dispersible polymer of hydroxystyrene.

U.S. Pat. No. 4,992,115 to Ikeda describes a surface treatment chemical for aluminum which includes 10-1000 parts by weight vanadium or cerium ion, 10-500 parts by weight zirconium ion; 10-500 parts by weight phosphate ion and 1-50 parts by weight "effective" fluorine ion with a pH of 2-4.0. According to Ikeda, effective fluorine ion means "isolated fluorine" that can be measured with a meter with a fluorine ion electrode. The is apparently contrasted with the sources of zirconium which include zirconium associated with fluorine in compounds such as $H_2ZrF_6$.

U.S. Pat. No. 6,027,579 to Das et al. describes a non-chrome rinse composition for rinsing and sealing phosphate conversion coatings. The rinse includes zirconium ions, vanadium ions, fluoride ions and phosphate ions with optional nitrate ions at a dilute concentration for rinsing. Das did not conversion coat, but rather describes a rinse for a conversion coating and does not describe critical ratios of zirconium atoms to fluoride atoms and vanadium atoms to phosphate ions for his rinse composition.

Finally U.S. Pat. No. 6,083,309 to Tomlinson describes Group IV-A protective films for solid surfaces that include aluminum and steel. Tomlinson's compositions include zirconium (as a Group IV-A metal) at a concentration of $1\times10^{-6}$ moles per liter to about 2.0 moles per liter; at least one anion with a charge-to-radius ration of less than 0.735; not more than 4 fluoride atoms per Group IV-A metal; a pH of less than 5; and water. According to Tomlinson, his compositions are very sensitive to fluoride and he prefers to have no fluoride mixed with his Group IV-A metal as this could cause gelling. Hence his composition is limited to low levels of fluoride relative to the Group IV-A metal such as zirconium. This level is no more than four fluorides to one zirconium.

Some of these alternative non-chrome coatings, particularly those containing organics, are water soluble and may stain or discolor the surfaces of the substrate. Further, non-chrome conversion coating compositions with organics are undesirable because they may interfere or damage the water recycling and reconditioning systems used at metal treatment plants, and may leave residues that interfere with the adherence of paints and other over-coatings.

SUMMARY

A composition and method is provided for conversion coating ferrous metal surfaces using a zirconium and vanadium aqueous conversion coating composition which is substantially free of film forming organic polymer compositions, other organics such as tannin as well as chrome. The method and composition permit the conversion coating of the ferrous metal surface over a wide pH range, a low temperature range and where the pH of the aqueous composition may be readily adjusted to account for the degree of oxidation of the ferrous metal surface.

The invention includes contacting the ferrous metal surface to an aqueous conversion coating composition comprising zirconium complexed with fluoride in the form of $ZrF_6^{-2}$ ions, vanadium/oxygen complex ions, and phosphate ions in a ratio and a concentration effective for providing coated ferrous metal substrate with a protective conversion coating. The aqueous composition has a pH in the range of from about 2.0 to 5.0 and a ratio of fluoride to zirconium in the aqueous composition of at least 6 fluoride ions to one zirconium ion. In an important aspect, the ratio of vanadium to phosphate ions should be in the range of from 0.5 to 2.4, and preferably 0.6:1 to 1.5 to minimize the amount phosphate by virtue of environmental concerns. In another important aspect, the ratio of zirconium atoms to vanadium atoms is in the range of 1:2 to 2:1.

The metal surface should be contacted with the aqueous composition for sufficient time, effective to provide a conversion coated surface, at from about 70° F. to about 90° F., preferably about 80° F. Generally, this would be for about 30 seconds to about 2 minutes. The aqueous composition is substantially free, and preferably completely free of organic film forming polymers and tannins.

Without intending to be bound by any theory, the conversion coating composition and method balances the amount and ratio of zirconium, vanadium (as vanadium/oxygen complexes), fluoride, $H^+$ ions, nitrate ions (from nitric acid which is an important source of $H^+$ ions), and phosphate ions in water such that the fluoride complexes with zirconium in a ratio of at least 6 fluorides to one zirconium. Nitric acid provides an appropriate pH and the nitrate ions provide for a sequestering function and buffering control, and the phosphate ions are in an amount that permits conversion coating with zirconium, vanadium and residual iron in the coating composition at a pH above about 4, and generally in the range of about 4 to about 5. The conversion coating composition permits a method which needs relatively low amounts of phosphate ions where the method can be operated at low temperatures over relatively wide pH ranges and permits pH drift which occurs in commercial conversion coating processes without adverse effect on a production line. This is because at a pH range of about 2.0 to about 3.5, the $ZrF_6^{-2}$ and $VO_2^+$ will associate with oxygen on the surface of the oxidized ferrous metal substrate to form zirconium fluoride, vanadium oxide complexes. In this aspect and pH the ions in solution are $ZrF_6^{-2}$, $VO_2^+$, $NO_3^-$, $PO_4^{-3}$, and $H^+$. The latter reactions contemplate an oxidized surface for the formation of a conversion coating.

At a pH of above about 3 and generally in the range of about 4 to about 5.0, the ions in solution are $ZrF_6^{-2}$, $(V_{10}O_{28})^{-6}$, $NO_3^-$, $PO_4^{-3}$, and $H^+$. At this higher pH, mixed phosphates of zirconium and vanadium form and associate with the unoxidized surface of the metal (metal—$PO_4$—Zr and metal—$PO_4$—V and metal—$PO_4$—Fe) as well as metal—O—V. These latter reactions do not require a highly oxidized surface to provide a conversion coating. There also will be some of the same reactions of $ZrF_6^{-2}$ and $VO_2^+$ with the metal surface which are described as occurring at the lower pH of 2.0 to 3.5. As can be seen, the process not only permits pH drift in the aqueous conversion coating composition bath and still provides a coating, but also permits a conversion coating at low temperatures where the oxidation of the surfaces of the work pieces vary.

The source of the ions used in the conversion coating composition include without limitation, hydrofluorozirconic acid, fluoroboric acid, phosphoric acid and ammonium metavanadate. The coating composition typically has a pH of not more than about 5.0, and in an important aspect is in the range of from about 2 to 5.0, to stabilize and reduce the potential precipitation of zirconium, zirconium complexes, phosphate ions and other metal ions in the aqueous coating composition as well as permit the vanadium/oxide complexes to associate with an unoxidized ferrous metal surface at a pH above about 4.

The coating composition which forms the process bath typically contains phosphate ions concentrations in the range of about 50 to 180 ppm, a reduction of greater than 50 fold compared to traditional iron and zinc/iron phosphate processes, and is applied at ambient temperature thereby significantly reducing application energy costs.

In an important aspect, the coating composition has from about 90 to about 185 ppm zirconium atoms, from about 50 to about 110 ppm vanadium atoms, 178 to about 360 ppm fluoride atoms, from about 50 to about 180 ppm phosphate ions and from about 280 to about 565 ppm nitrate ions with at least six of the fluoride atoms being complexed with the zirconium and the vanadium atoms being associated with oxygen and being in a ratio with the phosphate ions as described above. In a particularly important aspect, the coating composition has from about 110 to about 150 ppm zirconium atoms, from about 65 ppm to about 95 ppm vanadium atoms, from about 180 ppm to about 300 ppm fluoride atoms and from about 100 ppm to about 140 ppm phosphate ions where the source of the zirconium atoms is hydrofluorozirconic acid, the source of fluoride is hyrofluorozirconic acid and fluoroboric acid, the source for the vanadium/oxygen complexes is ammonium meta vanadate ($NH_4VO_3$), the source of the phosphate ions is phosphoric acid and the pH is provided by nitric acid and other acids in the system.

The ratio of zirconium atoms to vanadium atoms in the aqueous composition is in the range of from about 1:2 to about 2:1, and the ratio of zirconium atoms to fluoride atoms is in the range of from 1: to at least 6 fluorides to one zirconium. More fluoride atoms are unnecessary to complex with zirconium to provide a soluble zirconium fluoride ionic complex, such as $ZrF_6^{-2}$. While not intending to be bound by theory, it is believed that the latter zirconium/fluoride complex is important. Hence in an important aspect, a source of fluoride ions, such as fluoroboric acid, may be used to drive any equilibrium in the coating composition bath to assure that there is sufficient $ZrF_6^{-2}$ ions in the conversion coating composition so that there will be a sufficient amount of the latter complex to coat the ferrous surface.

The aqueous composition for a working aqueous bath for treating the ferrous metal surface and the conversion coating concentrate to make the aqueous bath may also include other non-ionic components to assist in the operation or maintenance of the coating composition. These components include chelating agents to condition the aqueous solution. The chelating agent may be penta-sodium diethylene triamine penta acetate or hydroxy ethylene-1,1, diphosphonic acid. The concentrate generally is diluted with water such that the concentrate comprises from about 2 to about 6 percent by volume of the working coating composition bath which produces the conversion coating with the pH of the working bath (diluted concentrate) being adjusted to not more than about 5.0.

The pH and the fluoride concentration in the concentrate composition are balanced to stabilize the active ingredients, such as zirconium/fluoride complex of $ZrF_6^{-2}$, vanadium/oxygen ionic complexes and phosphate ions with nitric acid supplying at least part of the $H^+$ ions, so that the concentrate remains as a solution without substantial precipitates over an extended period of time. Generally this balance and stability is provided by a pH of about 1.5 to about 3.0 in the concentrate. The ratio of vanadium and phosphate are balanced to assure there is sufficient phosphate to react with vanadium, zirconium and iron at higher pH reaction conditions. In one aspect, the concentrate composition is an aqueous solution that comprises an aqueous mixture of from 1 to about 2 weight percent of 45 weight % hydrofluorozirconic acid, from 0.5 to about 0.75 weight percent of 48 weight % fluoroboric acid, from about 0.3 to about 0.5 weight percent of ammonium meta vanadate ($NH_4VO_3$), from 0.3 to about 0.5 weight percent of 75 weight percent phosphoric acid and the pH is adjusted to a range of from about 1.5 to about 3 with nitric acid.

DETAILED DESCRIPTION

Figure 1:
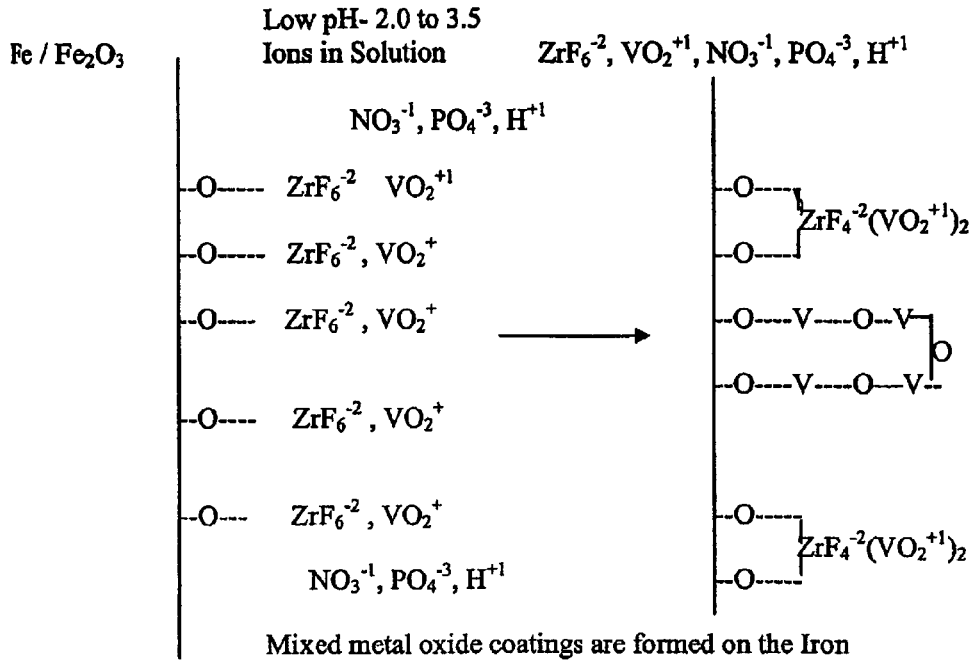
FIG. 1 depicts reactions of the coating composition with a ferrous surface at lower pHs.
Figure 2:
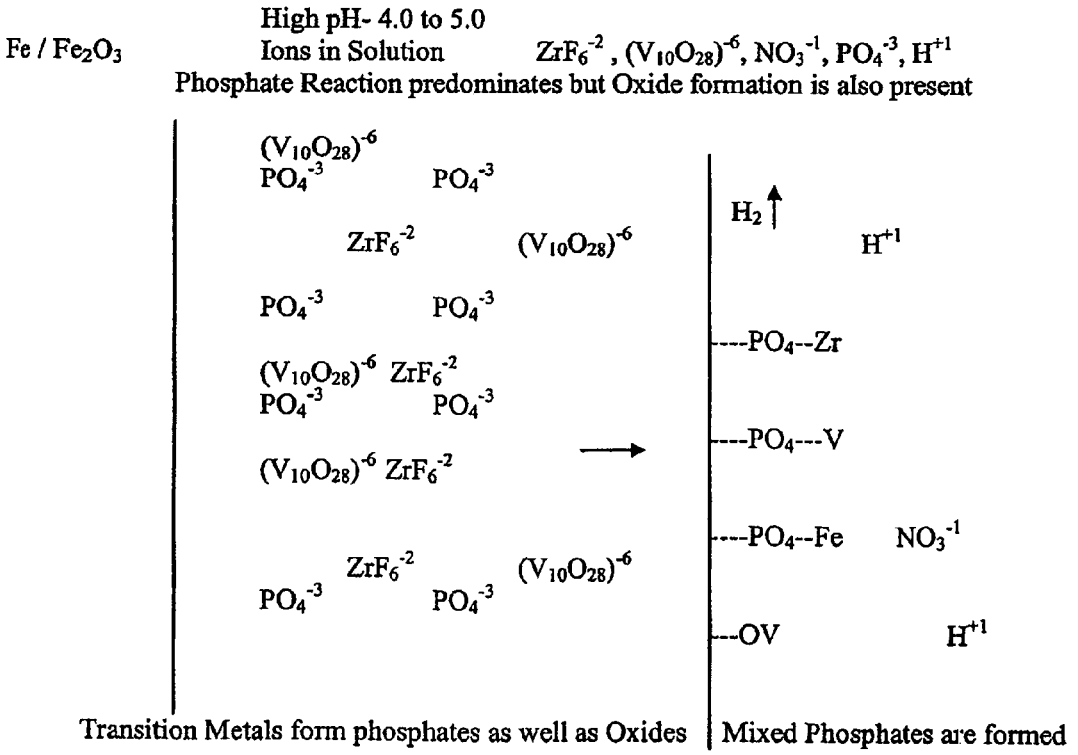
FIG. 2 depicts reactions of the coating composition with a ferrous surface at higher pHs.

As used herein, conversion coating composition or coating composition means an aqueous bath which is used to apply the conversion coating described herein.

As used herein, conversion coating composition concentrate or concentrate means the precursor composition to the conversion coating composition which is diluted with deionized water to make the conversion coating composition which is used to apply the conversion coating described herein. The reactive conversion coating composition is prepared from a concentrate for ease of transportation and storage. The concentrate is prepared by mixing under controlled conditions a water soluble source of zirconium, fluoride, vanadium, phosphate ions and $H^+$ ions in amounts that may be diluted to provide an effective coating composition as further discussed below.

As used herein deionized water means water that may be produced by passing water through a column which removes metal cations such as calcium and magnesium, and anions such as sulfate and chloride.

As used herein ferrous metal means iron and carbon steel alloys, such as cold-rolled steel, hot rolled steels, electro galvanized steel and other iron or steel products capable of treatment with phosphate conversion coatings.

Substantially free of an organic film forming composition means that not more than 0.01 weight percent of the conversion coating composition has a polymer or monomers which apply an organic protective film onto the surface of the ferrous metal substrate, and preferably not more than trace amounts.

Substantially free of tannins means that not more than 0.01 weight percent of the conversion coating composition has tannins, and preferably not more than trace amounts.

Non-chrome conversion coating composition means a conversion coating composition with not more than 0.01 weight percent of chrome or chrome ions, and preferably not more than trace amounts.

It is necessary to control both the pH and fluoride ion content to maintain the zirconium and vanadium in solution and in valance states to provide a coating composition. Accordingly, nitric acid, citric acid, oxalic acid, hydroxy acetic acid, acetic acid and formic acid may be used as pH-adjusting agents are used in amounts that provide a pH in the concentrate and coating composition that maintains the metal containing ions in solution and provides a pH of about 2 to about 5.0 in the coating composition or working bath which applies the conversion coating. Acids such as sulfuric acid or hydrochloric acid should be avoided as they provide sulfate or chloride ions which would contaminate the working bath. Nitric acid which not only supplies $H^+$ ions but also supplies nitrate ions is an important source of pH control.

Similarly, the water source used to prepare the concentrates and the conversion coating composition may include trace metal or other ionic impurities that interfere with the proper operation of the coating composition. Thus, it is preferable to incorporate stabilizing and chelating agents such as penta-sodium diethylene triamine penta acetate or other similar agents and water conditioners known to the art to reduce or eliminate and interference by such impurities with the activity of the coating composition.

The sources for water soluble zirconium and fluoride containing ions, fluoride ions, phosphate ions and vanadate ions as a source of $V^{+5}$ ions (which are associated with oxygen the degree of association depending upon the equilibrium at the precise pH of the bath) are hydrofluorozirconic acid (45%), fluoroboric acid (48%), phosphoric acid for phosphate and ammonium metavanadate and nitric acid ($HNO_3$) for $H^+$ and nitrate ($NO_3^-$) ions. The vanadium/oxygen complexes form by the following reactions.

$$10VO_2^+ + 8H_2O = [H_2V_{10}O_{28}]^{4-} + 14H^+ \quad K = 10^{-6.75}$$

$$[H_2V_{10}O_{28}]^{4-} = [HV_{10}O_{28}]^{5-} + H^+ \quad K = 10^{-3.6}$$

$$[HV_{10}O_{28}]^{5-} = [V_{10}O_{28}]^{6-} + H^+ \quad K = 10^{-5.8}$$

The selection of the specific ion sources will depend on their commercial availability and stability in the solution at the operating pH of the conversion coating process. For example, zirconium compounds at the operating pH of the coating composition and the concentrate hydrolyze to form insoluble precipitates or react to form insoluble phosphate compositions should be avoided because the loss of the reactive components of the concentrate and conversion coating composition significantly reduce the effectiveness of the coating composition.

In one example of the concentrate of the invention, an aqueous mixture of the above components is mixed at a pH of about 1.5 to about 3.0 and including the following components: nitrate ions at a concentration of approximately 9370 ppm supplied from nitric acid, 3006 ppm zirconium which is a part of a zirconium/fluoride complex of $ZrF_6^{-2}$ ions at a concentration of approximately 6000 ppm supplied from 45% hydrofluorozirconic acid, fluoroborate ions at a concentration of approximately 2800 ppm supplied from 48% fluoroboric acid, 5948 ppm fluoride also supplied from the 45% hydrofluorozirconic acid and the 48% fluoroboric acid, phosphate ions at a concentration of approximately 2940 ppm supplied from 75% phosphoric acid, 1760 ppm vanadium as a part of a vanadium/oxygen complex and supplied from ammonium meta-vanadate, and penta-sodium diethylene triamine penta acetate (40%) at a concentration of approximately 1012 ppm. The concentrate is preferably diluted with deionized water to about 2 to about 6% by volume for use as the conversion coating composition.

Typically, the substrate (such as cold-rolled steel, hot rolled steels, electro galvanized steel and other irons or steel products capable of treatment with the conversion coating composition) is formed through a bending, stamping, forging or other such forming process and cleaned with an alkaline cleaner or other such treatment to remove oils, dirt, metal fines or other surface contaminates. The cleaned substrate is then rinsed with fresh water (preferably deionized water) and is subjected to the conversion coating composition using a spray, a dip, a bath or other such application means.

After treatment with the coating composition, the metal substrate is typically exposed to a rinse with water, preferably deionized water and is dried. Alternatively, the final water rinse and drying steps may be omitted or modified to adapt the method of the invention to specific application systems and specific painting or over-coating applications. The dry substrate may then be painted, printed with inks, coated with lacquers or electrically deposited liquid or powders, or otherwise over coated. When properly applied and adapted for specific applications, the conversion coating composition of the invention provides improved characteristics such as improved adhesion of subsequent organic coatings and improved corrosion resistance as measured by salt spray testing.

Example I

For one aspect of the invention, a concentrate was prepared with the following components which were blended in water. The concentration of those components generally was as follows:

| Source | Component | Concentration of Effective Component (in ppm) |
|---|---|---|
| Nitric Acid | Nitrate | about 450 |
| Hydrofluoro-zirconic Acid (45%) | Zirconium ions | about 150 |
| Fluoroboric Acid | Fluoroborate ions | about 125 |
| Phosphoric Acid | Phosphate ion | about 145 |
| Ammonium Meta-Vanadate | Vanadium ions | about 88 |
| Penta-Sodium Diethylene Triamine Penta Acetate | Chelating agent | about 50 |

The total free fluoride in the concentrate was about 6000 ppm (as supplied by the hydrofluorozirconic acid and the fluoroboric acid), and the concentrate was maintained at a pH of about 1.5 to 3.0. As mentioned above, the fluoride concentration and pH were adjusted to provide a stable blend and to minimize precipitation of the phosphates and metals.

The coating composition was applied to a number of ferrous metal substrates, generally for about 45 seconds at 80° F. unless otherwise noted. These treated samples were typically painted or otherwise over-coated and then exposed to salt water in a salt fog or spray test as described by the ASTM standard B 117. The salt spray tests were typically run either for a set number of hours, after which the corrosion or "creepage" and loss of paint adhesion were measured and rated pursuant to ASTM standard D 1654. Alternatively, the salt spray tests were continued until a predetermined amount of measurable creep and loss of paint adhesion was detected, and the length of time required to produce that amount of creep was used to compose the effectiveness of the conversion coating.

Generally in the salt spray test, the conversion coated, rinsed and painted panels were scribed to a depth suitable to expose the underlying ferrous metal substrate. The scribed panels were then placed in a test cabinet and exposed to a continuous fog or spray of approximately 5% sodium chloride salt with a pH in the range of about 6.5 to 7.2, and at a temperature of about 95° F. (35° C.). The panels were positioned so that the salt solution droplets ran lengthwise along the scribe. After prescribed time elapsed, the panels were rinsed with fresh water to remove salt deposits from their surfaces. The panels were scraped per ASTM D-1654 to remove any loose paint. The nature of any corrosion in terms of measured creepage was evaluated, as were any other evidence of paint failure or corrosion. Unless otherwise noted, paints or over-coats, and the test conditions for the samples that are in each example which compared and discussed in each example below were substantially same.

Example II

A conversion coating composition having the following ingredients is used to conversion coat a ferrous metal substrate at 80° F. using a spray at 5-15 psi for about 45 seconds to one minute.

| | |
|---|---|
| 150 ppm | Zirconium |
| 300 ppm | Fluoride |
| 88 ppm | Vanadium |
| 450 ppm | Nitrate Ions |
| 145 ppm | Phosphate Ions |
| 50 ppm | E.D.T.A. (ethylene diamine tetracedic acid) |

Five Stage Treatment Process

Alkaline Clean, Water Rinse, Treatment Bath, Water Rinse and Seal Rinse

Paint Type—Cathodic E-Coat

Substrates—Cold Roll Steel, Hot Roll Steel

Test Methods—A.S.T.M. B-117 & A.S.T.M. D-1654 500 hours Salt Spray Results

Control Method 1—Alkaline Clean only Substrates

Control Method 2—Standard Iron Phosphate

RESULTS—Millimeters of paint peel back from the scribe

Sample 1 Cold Roll Steel—0.6 mm, 1.2 mm, Hot Roll Steel—0.3 mm, 0.5 mm

Control 1 Cold Roll Steel—5.2 mm, 4.4 mm, Hot Roll Steel—8.7 mm, 4.4 mm

Sample 2 Cold Roll Steel—3.0 mm, 8.2 mm

Control 2 Cold Roll Steel—5.5 mm, 6.6 mm

Paint Type—TGIC Powder

Substrates—Cold Roll Steel,

Test Methods—A.S.T.M. B-117 & A.S.T.M. D-1654 500 hours Salt Spray Results

Control Method 1—Alkaline Clean only Substrates

Control Method 2—Standard Iron Phosphate

RESULTS—Millimeters of paint peel back from the scribe

Sample 1 Cold Roll Steel—0.9 mm, 0.8 mm, −0.6 mm, 0.5 mm

Sample 2 Cold Roll Steel—1.4 mm, 1.2 mm, 1.9 mm, 1.4 mm

Control 2 Cold Roll Steel—0.9 mm, 1.9 mm, −2.5 mm, 1.9 mm

Four Stage Treatment Process

Alkaline Clean, Water Rinse, Treatment B and Water Rinse

Paint Type—TGIC Powder

Substrates—Cold Roll Steel Production parts,

Test Methods—A.S.T.M. B-117 & A.S.T.M. D-1654 744 hours Salt Spray Results

Control Method 1—Alkaline Clean only Substrates

Control Method 2—Standard Iron Phosphate

RESULTS—Millimeters of paint peel back from the scribe

Sample 1 Cold Roll Steel—1.5 mm, 1.3 mm, 1.5 mm,

Control 1 Cold Roll Steel—6.4 mm, 7.6 mm, –8.8 mm

Sample 2 Cold Roll Steel—2.4 mm, 3.3 mm, *

Control 2 Cold Roll Steel—8.4 mm, 7.6 mm, *

* 500 Hours Salt Spray

Paint Type—Cathodic E-Coat

Substrates—Production Cold Roll Steel, Production Galvanized Steel

Test Methods—A.S.T.M. B-117 & A.S.T.M. D-1654 500 hours Salt Spray Results

Control Method 1—Alkaline Clean only Substrates

Control Method 2—Standard Iron Phosphate

RESULTS—Millimeters of paint peel back from the scribe

Sample 1 Cold Roll Steel—2.8 mm, 1.5 mm, 3.0 mm,

Control 1 Cold Roll Steel—8.4 mm

Control 2 Cold Roll Steel—2.7 mm, 3.2 mm, –3.2 mm

Sample 2 Galvanized Steel—2.5 mm, 2.8 mm, 2.8 mm

Control 1 Galvanized Steel—10.0 mm

Control 2 Galvanized Steel—1.8 mm, 1.9 mm,

Three or Four Stage Treatment Process

Alkaline Clean, Water Rinse and Treatment Bath—Dry

Alkaline Clean, Water Rinse, Water Rinse and Treatment Bath—Dry

Paint Type—Liquid Spray Epoxy

Substrates—Production Cold Roll Steel

Test Methods—A.S.T.M. B-117 & A.S.T.M. D-1654 500 hours Salt Spray Results

Control Method 1—Alkaline Clean only Substrates

Control Method 2—Standard Iron Phosphate

RESULTS—Millimeters of paint peel back from the scribe

Sample 1-pH=2.4 Cold Roll Steel—1.2 mm, 2.3 mm, 1.9 mm,

Sample 1-pH=4.0 Cold Roll Steel—0.7 mm, 0.9 mm, 1.6 mm,

Control 1 Cold Roll Steel—19.5 mm, 17.82 mm, 21.8 mm

Control 2 Cold Roll Steel—1.1 mm, 0.7 mm,

Paint Type—T.G.I.C. Powder Paint

Substrates—Production Cold Roll Steel

Test Methods—A.S.T.M. B-117 & A.S.T.M. D-1654 500 hours Salt Spray Results

Control Method 1—Alkaline Clean only Substrates

Control Method 2—Standard Iron Phosphate

RESULTS—Millimeters of paint peel back from the scribe

Sample 1-pH=2.9@1% Cold Roll Steel—0.6 mm, 0.3 mm,

Sample 2-pH=2.2@5% Cold Roll Steel—0.6 mm, 0.5 mm,

Sample 3-pH=2.9@1% Cold Roll Steel—1.1 mm, 0.9 mm

Control 1 Cold Roll Steel—4.5 mm, 3.9 mm,

Control 2 Cold Roll Steel—6.1 mm, 6.0 mm,

What is claimed is:

1. A process for forming a conversion coating on a ferrous metal surface, the process comprising:

exposing the ferrous surface to an aqueous composition comprising zirconium as $ZrF_6^{2-}$ ions, vanadium as a part of vanadium/oxygen ions, fluoride as a part of the $ZrF_6^{2-}$— ions, nitrate ions and phosphate ions in a ratio and a concentration effective for providing the ferrous metal surface with a protective conversion coating, the aqueous composition comprising from 90 to 185 ppm zirconium, from 178 to 360 ppm fluoride, from 50 to 110 ppm vanadium, and from 50 to 180 ppm phosphate ions, the aqueous composition having a pH in the range of from 2.0 to 5.0, the aqueous composition forming the protective conversion coating which includes zirconium and vanadium throughout the pH range and forming a protective conversion coating on the metal surface which includes zirconium, vanadium and phosphate at a pH of from about 4 to about 5, the aqueous composition being substantially free of an organic film forming composition and tannins, the ratio of fluoride to zirconium in the aqueous composition at least 6 fluoride to one zirconium, the ratio of zirconium to vanadium in the range of 1:2 to 2:1 to provide the conversion coating on the ferrous metal surface, the conversion coating including at least zirconium and vanadium on the ferrous metal surface and the conversion coating on the metal surface consisting essentially of zirconium, vanadium, oxygen and phosphate when the ferrous metal surface is exposed to the aqueous composition at a pH of from about 4 to about 5.

2. The process according to claim 1, wherein the ferrous metal surface is exposed to the aqueous composition at a temperature of from 70° F. to 90° F.

3. The process according to claim 2 wherein the ferrous metal surface is exposed to the aqueous composition for 30 seconds to two minutes.

4. The process according to claim 2 wherein the aqueous composition further includes from 280 to 565 ppm nitrate ions.

5. The process according to claim 4, wherein the aqueous composition includes a source of zirconium and fluoride which comprises hydrofluorozirconic acid and fluoroboric acid, a source of phosphate ions which comprises phosphoric acid, a source for vanadium which comprises ammonium metavanadate and a source for hydrogen and nitrate ions which comprises nitric acid.

6. The process according to claim 1, wherein the ferrous metal surface is exposed to the aqueous composition at a temperature of from 70° F. to 90° F. and the aqueous composition includes a source of zirconium and fluoride which comprises hydrofluorozirconic acid and fluoroboric acid, a source of phosphate ions which comprises phosphoric acid, a source for vanadium which comprises ammonium metavanadate and a hydrogen ion source which comprises nitric acid.

7. The process according to claim 1, wherein the aqueous composition provides a conversion coating consisting essentially of zirconium, vanadium, fluoride and oxygen on the ferrous metal surface when the ferrous surface is exposed to the aqueous composition at a pH of from about 2.0 to about 3.5, and wherein the aqueous composition provides a conversion coating consisting essentially of zirconium, vanadium, oxygen and phosphate on the ferrous metal surface when the ferrous surface is exposed to the aqueous composition at a pH of from about 4.0 to about 5.

8. The process according to claim 7, wherein the aqueous composition provides a conversion coating consisting essentially of $ZrF_4$, $VO_2$ and oxygen when the ferrous metal surface is exposed at a pH of from about 2.0 to about 3.5.

9. A process for forming a conversion coating on a ferrous metal surface, the process comprising:

exposing the ferrous metal surface at a temperature of from 70° F. to 90° F. to an aqueous composition comprising zirconium as $ZrF_6^{2-}$ ions, vanadium as a part of vanadium/oxygen ions, fluoride as a part of the $ZrF_6^{2-}$ ions, nitrate ions and phosphate ions in a ratio and a concentration effective for providing the ferrous metal surface with a protective conversion coating, the aqueous composition having a pH in the range of from about 2.0 to 5.0, the aqueous composition forming the protective conversion coating comprising at least zirconium and vanadium throughout the pH range and forming a protective conversion coating on the metal surface which includes zirconium, vanadium and phosphate at a pH of from about 4 to about 5, and a ratio of fluoride to zirconium in the aqueous composition of at least 6 fluoride to one zirconium, a ratio of zirconium to vanadium in the range of from 1:2 to 2:1, the zirconium and fluoride being from a source comprising hydrofluorozirconic acid and fluoroboric acid, the phosphate ions being from a phosphate source comprising phosphoric acid, the vanadium being from a vanadium source comprising ammonium metavanadate and the nitrate ions being from a source comprising nitric acid, the aqueous composition being substantially free of an organic film forming composition and tannins, and the aqueous composition comprising from 90 to 185 ppm zirconium, from 178 to 360 ppm fluoride, from 50 to 110 ppm vanadium, from 50 to 180 ppm phosphate ions and from 280 to 565 ppm nitrate ions to provide the conversion coating on the metal surface, the conversion coating including at least zirconium and vanadium on the ferrous metal surface and the conversion coating on the metal surface consisting essentially of zirconium, vanadium, oxygen and phosphate when the ferrous metal surface is exposed to the aqueous composition at a pH of from about 4 to about 5.

10. The process according to claim 9 wherein the ferrous metal surface is exposed to the aqueous composition for 30 seconds to two minutes.

11. A process for forming a conversion coating on a ferrous metal surface, the process comprising:

exposing the ferrous metal surface at a temperature of from 70° F. to 90° F. to an aqueous composition comprising zirconium as $ZrF_6^{2-}$ ions, vanadium as a part of vanadium/oxygen ions, fluoride as a part of the $ZrF_6^{2-}$ ions, nitrate ions and phosphate ions in a ratio and a concentration effective for providing the ferrous metal surface with a protective conversion coating which includes at least zirconium and vanadium, the aqueous composition having a pH in the range of from about 2.0 to 5.0 and capable of forming the protective conversion coating which includes at least zirconium and vanadium throughout the pH range, and a ratio of fluoride to zirconium in the aqueous composition of at least 6 fluoride to one zirconium, a ratio of zirconium to vanadium in the range of from 1:2 to 2:1, the zirconium and fluoride being from a source comprising hydrofluorozirconic acid and fluoroboric acid, the phosphate ions being from a source comprising phosphoric acid, the vanadium being from a source comprising ammonium metavanadate and the nitrate ions being from a source comprising nitric acid, the aqueous composition being substantially free of an organic film forming composition and tannins, and the aqueous composition consisting essentially of a hydrogen ion source, from 90 to 185 ppm zirconium, from 178 to 360 ppm fluoride, from 50 to 110 ppm vanadium, from 50 to 180 ppm phosphate ions and from 280 to 565 ppm nitrate ions to provide the conversion coating consisting essentially of zirconium, vanadium, fluoride and oxygen on a ferrous metal surface when the ferrous surface is exposed to the aqueous composition at a pH of from about 2.0 to about 3.5, the conversion coating consisting essentially of zirconium, vanadium, oxygen and phosphate when the ferrous surface is exposed to the aqueous composition at a pH of from about 4.0 to about 5.

12. The process according to claim 11 wherein the ferrous metal is exposed to the aqueous composition for 30 seconds to two minutes.

13. A process for forming a conversion coating on a ferrous metal surface, the process comprising:

exposing the ferrous metal surface to an aqueous composition comprising zirconium as $ZrF_6^{2-}$ ions, vanadium as a part of vanadium/oxygen ions, fluoride as a part of the $ZrF_6^{2-}$ ions, and from about 50 to about 180 ppm phosphate ions in a ratio and a concentration effective for providing the ferrous metal surface with a protective conversion coating, the aqueous composition having a pH in the range of from 2.0 to 5.0 and forming the protective conversion coating on the metal surface which conversion coating includes zirconium and vanadium throughout the pH range and forming a protective conversion coating on the metal surface which includes zirconium, vanadium, oxygen and phosphate at a pH of from about 4 to about 5, and the ratio of fluoride to zirconium in the aqueous composition at least 6 fluoride to one zirconium to provide the aqueous coating, the aqueous coating composition providing the conversion coating consisting essentially of $ZrF_4$, $VO_2$ and oxygen when the ferrous metal surface is exposed at a pH of from about 2.0 to about 3.5 and the aqueous composition providing the conversion coating composition consisting essentially of at least zirconium, vanadium, oxygen and phosphate when the ferrous metal surface is exposed at a pH of from about 4 to about 5.

14. The process according to claim 13, wherein the ferrous metal is exposed to the aqueous composition at a temperature of from 70° F. to 90° F. and the aqueous composition includes a source of zirconium and fluoride which comprises hydrofluorozirconic acid and fluoroboric acid, a source of phosphate ions which comprises phosphoric acid, and a source for vanadium which comprises ammonium metavanadate.

15. The process according to claim 13 wherein the aqueous composition comprises from 90 to 185 ppm zirconium, from 178 to 360 ppm fluoride, and from 50 to 110 ppm vanadium.

16. The process according to claim 15 wherein the ferrous metal surface is exposed to the aqueous composition at a temperature of from 70° F. to 90° F.

17. The process according to claim 16 wherein the ferrous metal surface is exposed to the aqueous composition for 30 seconds to two minutes.

* * * * *